US005410463A

United States Patent [19]

Jean et al.

[11] Patent Number: 5,410,463

[45] Date of Patent: Apr. 25, 1995

[54] LIGHTING ORNAMENT

[76] Inventors: Lai D. Jean, 3F-5, No. 77, Sec. 1, Chung Ching s. Rd., Taipei; Ching P. Wu, No. 72, Yung Fang Rd., Yung Fang Tsu, Tai Liao Hsiang, Koahsiung County, both of Taiwan, Prov. of China

[21] Appl. No.: 127,049

[22] Filed: Sep. 27, 1993

[51] Int. Cl.[6] ..... F21V 3/04

[52] U.S. Cl. ..... 362/398; 362/806; 362/347

[58] Field of Search ..... 362/398, 806, 808, 809, 362/84, 341, 346, 347, 350, 260

[56] References Cited

U.S. PATENT DOCUMENTS 2,641,683 6/1953 Dupler ..... 362/809

*Primary Examiner*—Ira S. Lazarus

*Assistant Examiner*—Sara Sachie Raab

[57] ABSTRACT

A lighting ornament comprised of a socket internally coated with a magnetic substance, a light emitting device fastened inside the socket to give light, at least one hollow ball respectively and peripherally coated with an inner layer of a magnetic substance of the same magnetic polarity of the magnetic substance on the socket and then coated with a fluorescent coating, whereby the at least one hollow ball is respectively floated within the socket by means of the effect of the magnetic repulsion force to reflect the light of the light emitting device in all directions.

5 Claims, 5 Drawing Sheets

LIGHTING ORNAMENT

BACKGROUND OF THE INVENTION

The present invention relates to a lighting ornament, and more particularly to such a lighting ornament comprising a ball floated within a socket, by means of the effect of a magnetic repulsion, to reflect the light of a light emitting device thereof in all directions.

Various lighting ornaments are known, and widely used for decoration. These lighting ornaments commonly use a lamp bulb or lamp tube to give light, and a shade made in any of a variety of forms to reflect or refract light. Because the shade is fixed in place, little variation is produced to attract people.

SUMMARY OF THE INVENTION

The present invention provides a floating ball for a lighting ornament which floats in the air to reflect light so as to produce a variable lighting effect.

According to one embodiment of the present invention, the lighting ornament comprises a top-open socket made gradually bigger toward the top and internally coated with a layer of a magnetic substance, a Light emitting device fastened within the socket to emit light toward the top opening of the socket, and a hollow ball externally coated with a layer of a magnetic substance or the same magnetic polarity of the magnetic substance on the socket and then coated with a layer of non-magnetic fluorescent coating. As the ball is put in the socket, it is immediately floated in the air by means of the effect of the magnetic repulsion force produced between two same magnetic polarities of magnetic substance on the socket and the magnetic substance on the ball. Therefore, the light of the light emitting device is reflected by the ball in all directions as the ball is floating in the air within the socket.

DETAILED DESCRIPTION OF THE PREFERRED EMBODIMENTS

Figure 1:
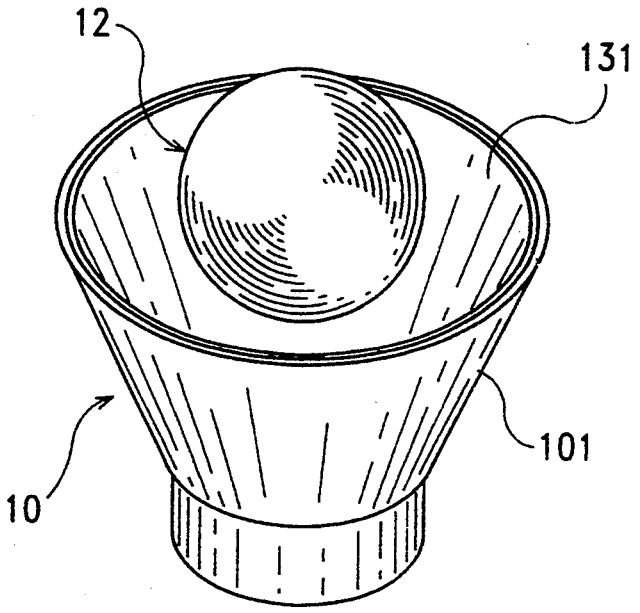
FIG. 1 is a perspective view of a lighting ornament according to a first embodiment of the present invention.
Figure 2:
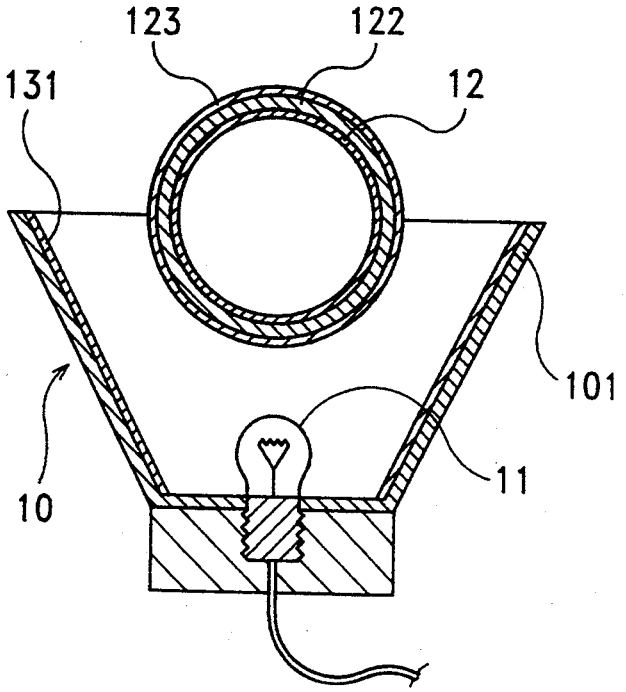
FIG. 2 is a side view in section of the lighting ornament of FIG. 1.

Referring to FIGS. 1 and 2, a lighting ornament is shown in accordance with a first embodiment of the present invention and generally comprised of a socket 10, a light emitting device 11, and a hollow ball 12. The socket 10 is bowl-shaped, having a top-open socket body 101 made gradually bigger toward the top and internally coated with an opaque layer of a magnetic substance 131. The light emitting device 11 is fastened inside the socket 10 at the bottom, and controlled to emit light toward the top opening or the top-open socket body 101. The hollow ball 12 is coated with an opaque layer of a magnetic substance 122, and then coated with a layer of non-magnetic fluorescent coating 123. The magnetic polarity of the magnetic substance 122 on the hollow ball 12 is same as the magnetic substance 131 on the socket body 101. As the ball 12 is put in the socket 10, a magnetic repulsion force is produced between the ball 12 and the socket 10, and therefore the ball 12 is supported in the air within the socket 10 by the magnetic repulsion force. Of course, the weight of the ball 12 must be properly calculated so that the magnetic repulsion force can surpass the gravity of the ball 12. As the light emitting device 11 is turned on to give light, light rays from the light emitting device 11 will be reflected by the fluorescent coating 123 of the ball 12 in all directions to produce a fantastic lighting effect. The light emitting device 11 can be made in any of a variety of forms. In this embodiment, the light emitting device 11 is a lamp bulb.

Figure 3:
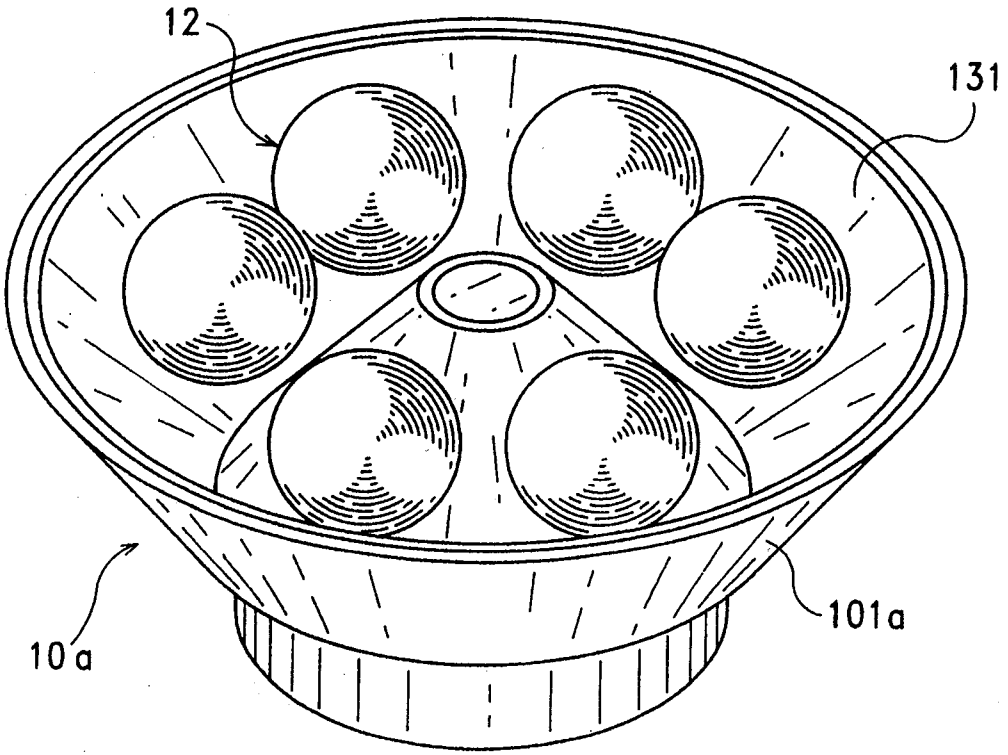
FIG. 3 is a perspective view of a lighting ornament according to a second embodiment of the present invention.
Figure 4:
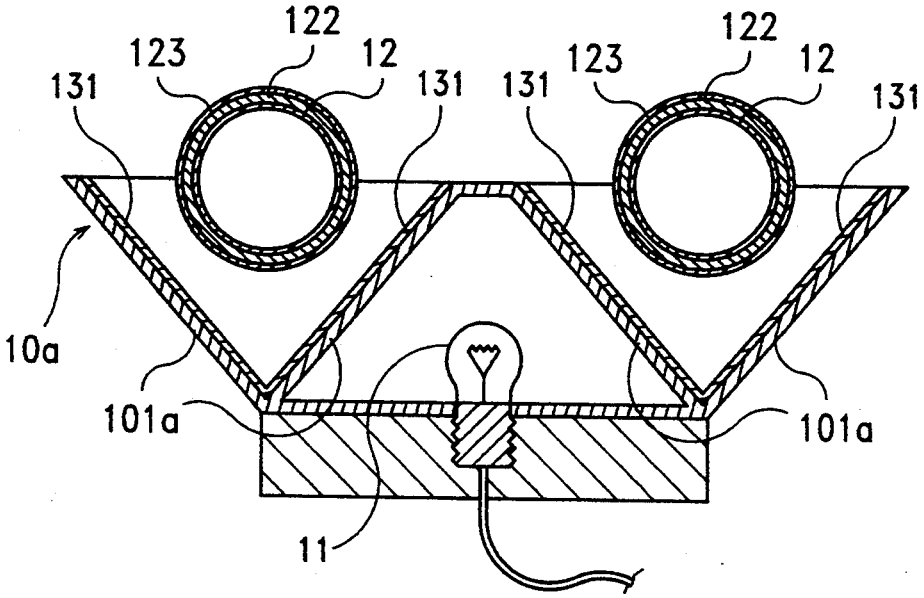
FIG. 4 is a side view in section of the lighting ornament of FIG. 3.
Figure 5:
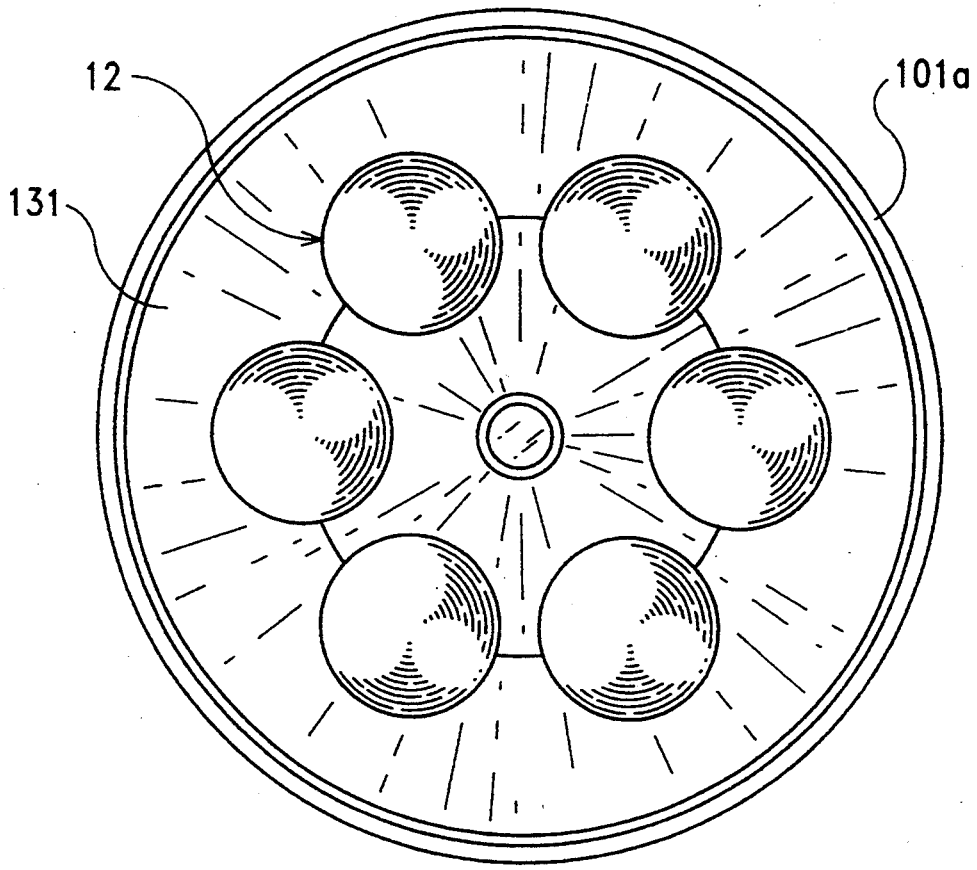
FIG. 5 is a top view of the lighting ornament of FIG. 3.

Referring to FIGS. 3, 4, and 5, therein illustrated is a lighting ornament; according to a second embodiment or the present invention. The lighting ornament is also comprised of a socket **10*a* at a bottom, a light emitting device 11 inside the socket 10*a*, and a plurality of balls 12. The light emitting device 11 and the balls 12 are identical to the light emitting device 11 and the ball 12 of the aforesaid first embodiment, and therefore respective reference numbers are used. The socket body 101*a* of the socket 10*a* is made in such a shape that its cross section is shaped like the English character "W". Therefore, a holding space of an endless V-groove is defined within the socket body 101*a*. As a plurality of balls 12 are put in the endless V-groove within the socket body 101*a* of the socket 10*a*, the balls 12 become supported in the air within the socket body 101*a* around a circle by the magnetic repulsion force produced between the magnetic substance 131 on the socket body 101*a* and the magnetic substance 122 on the balls 12**.

Figure 7:
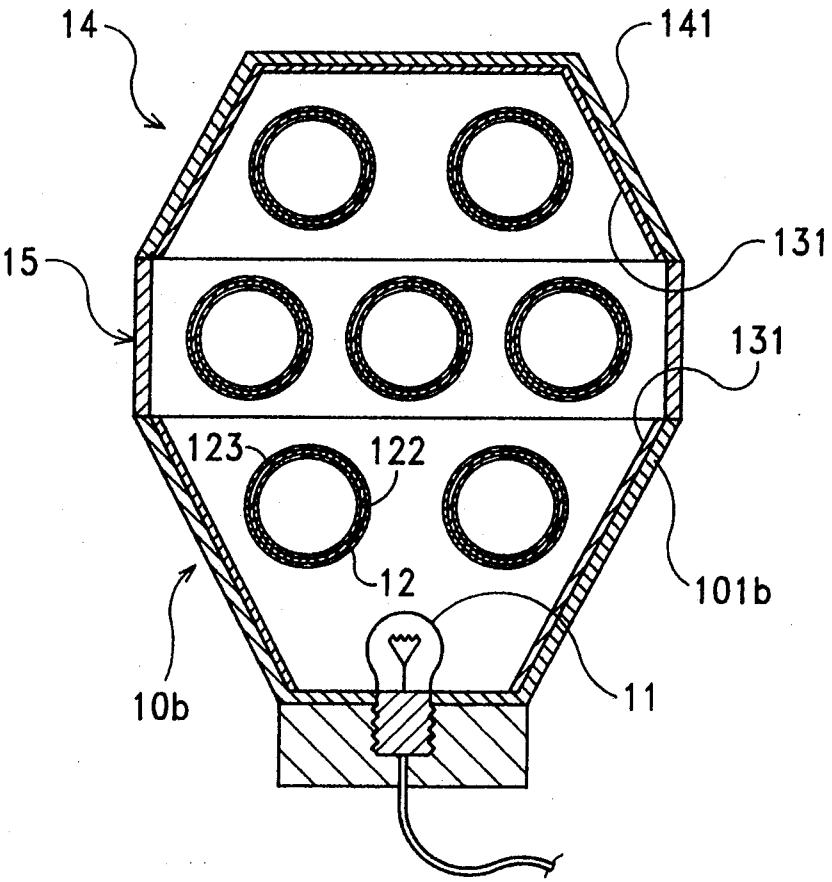
FIG. 7 is a side view in section of the lighting ornament of FIG. 6.
Figure 6:
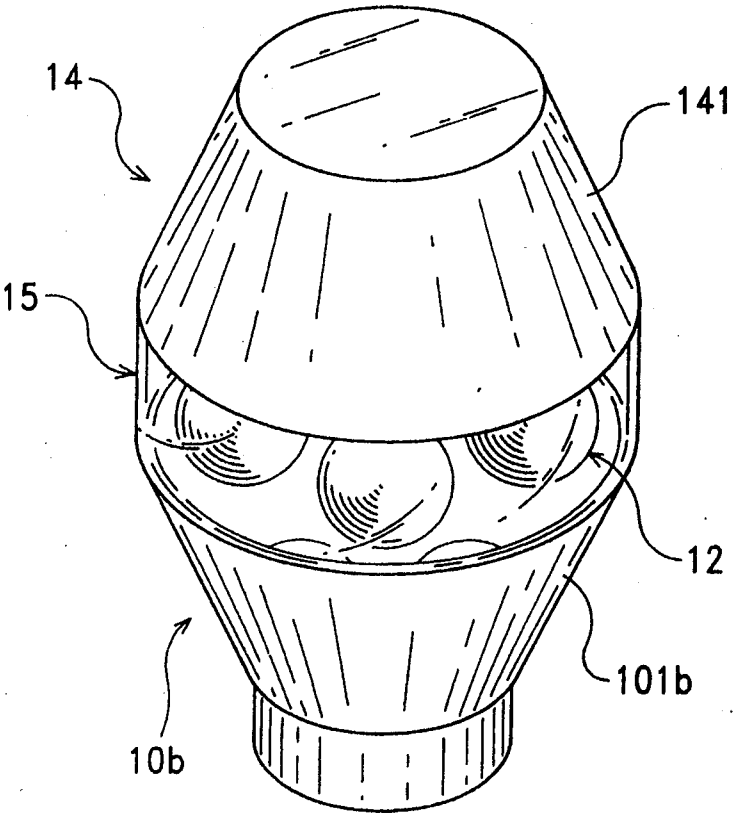
FIG. 6 is a perspective view of a lighting ornament according to a third embodiment of the present invention.

Referring to FIGS. 6, and 7, therein illustrated is a lighting ornament according to a third embodiment of the present invention, which is comprised of a socket **10*b*, an opaque shade 14, a transparent connecting ring 15, a light emitting device 11, and a plurality of balls 12. The light emitting device 11 and the balls 12 are identical to that of the aforesaid embodiments, and therefore respective reference numbers remain unchanged. The peripheral wall 141 of the shade 14 as well as the socket body 101*b* of the socket 10*b* are internally coated with a layer of a magnetic substance 131. The transparent connecting ring 15 connects the shade 14 to the socket 10*b*, and therefore an enclosed space is defined within the socket 10*b*, the shade 14, and the connecting ring 15. The balls 12 are floated within the enclosed space by means of the action of the magnetic repulsion force produced between magnetic substance 131 on the socket 10*b* and the shade 14, and the magnetic substance 122 on the balls 12**. The lighting ornament of this third embodiment is also suitable for hanging on the ceiling or a place overhead.

Figure 9:
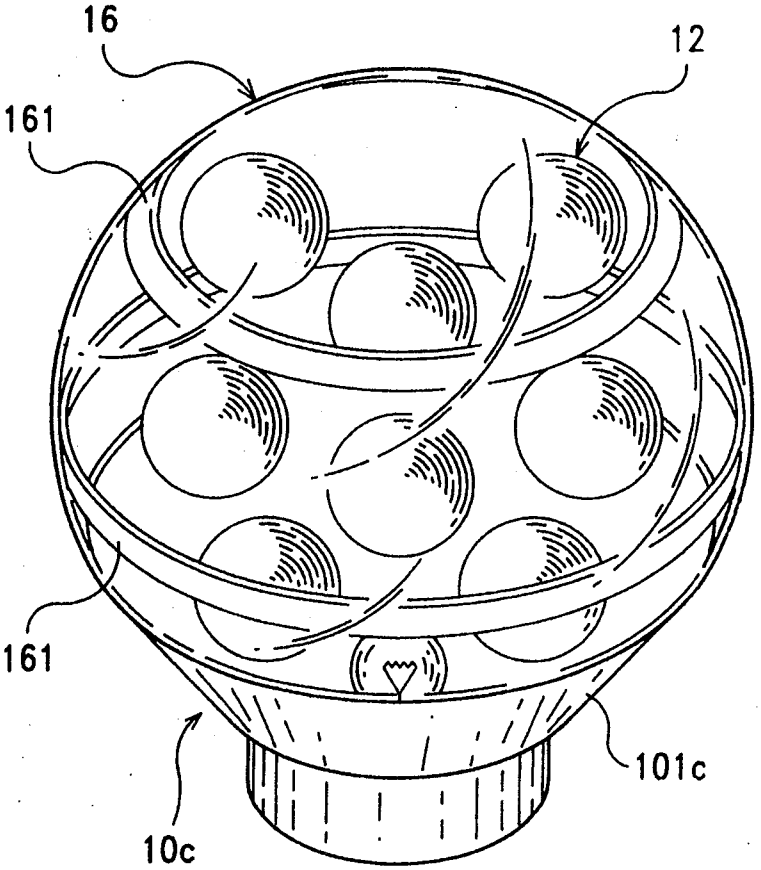
FIG. 9 is a side view in section of the lighting ornament of FIG. 8.
Figure 8:
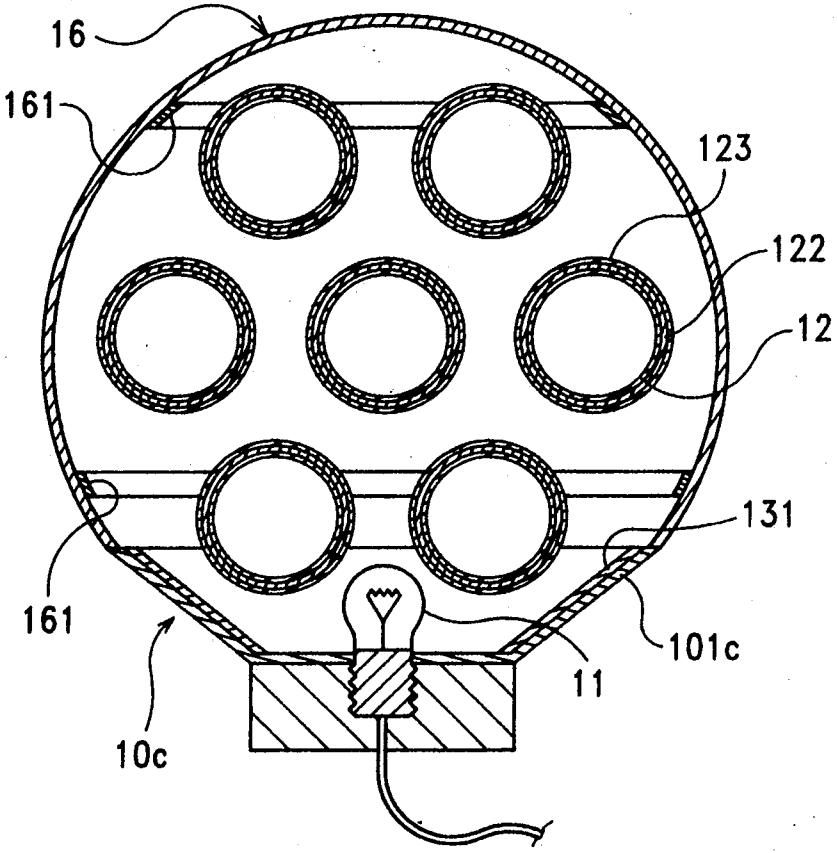
FIG. 8 is a perspective view of a lighting ornament according to a fourth embodiment of the present invention.

Referring to FIGS. 8 and 9, therein illustrated is a lighting ornament according to a fourth embodiment of the present invention. The light ornament of this embodiment is comprised of a socket 10*c*, a transparent shade 16 covered over the socket 10*c*, a light emitting device 11 fastened inside the socket 10*c* at the bottom, and a plurality of balls 12 floated within the enclosed space defined within the socket 10*c* and the transparent shade 16. The socket body 101*c* of the socket 10*c* is internally coated with a layer of a magnetic substance 131. The transparent shade 16 comprises a plurality of magnetic strips 161 fastened around the inside wall thereof at different elevations. Therefore, the balls 12 are floated within the transparent shade 16 and the socket 10*c* by means of the effect or the magnetic repulsion force produced between the magnetic strips 161 and the magnetic substance 131 on the socket 10*c*, and the magnetic substance 122 on the balls 12 of same magnetic polarity.

While only a few embodiments of the present invention have been shown and described, it will be understood that various modifications and changes could be made without departing from the spirit and scope of the invention.

What is claimed is:

1. A lighting ornament, comprising:

a socket, said socket comprising a holding space surrounded by an inside wall thereof, and a top opening communicated with said holding space, said inside wall being coated with an opaque layer of a magnetic substance;

a light emitting device fastened inside at a bottom of said socket and controlled to give light for illuminating said holding space; and at least one hollow ball respectively and peripherally coated with a layer or a magnetic substance of the same magnetic polarity as the magnetic substance on said inside wall of said socket, and then coated with a layer of fluorescent coating over the magnetic substance;

whereby said at least one hollow ball is floated in the air within said socket, by means of the magnetic repulsion force produced between the two same magnetic polarities of magnetic substances on said socket and on said at least one hollow ball, to reflect the light or said light emitting device.

2. The lighting ornament of claim 1 wherein said socket is made gradually bigger toward the top.

3. The lighting ornament of claim 1 wherein said holding space of said socket is made in the shape of an endless annular V-groove; said at least one hollow ball includes a plurality of hollow ball floated within said endless annular V-groove around a circle.

4. The lighting ornament of claim 1 which further comprises an opaque shade connected to said socket by a transparent ring, said shade being internally coated with a layer of a magnetic substance of the same magnetic polarity as the magnetic substance on said socket.

5. The lighting ornament of claim 1 which further comprises a transparent, hollow, spherical shade covered on said socket, said shade comprising a plurality of magnetic strips fastened around the inside wall thereof at different elevations, the magnetic polarity of said magnetic strips being the same as that of the magnetic substance on said socket.

* * * * *